US005526825A

United States Patent [19]

Ruppert et al.

[11] Patent Number: 5,526,825

[45] Date of Patent: Jun. 18, 1996

[54] SMOKING TOBACCO FOR SELF-MAKING A CIGARETTE, AND DEVICE THEREFOR

[75] Inventors: Heinrich W. Ruppert; Gunter Schutze; Klaus Gatschmann, all of Trossingen, Germany

[73] Assignee: EFKA-Werke Fritz Kiehn GmbH, Germany

[21] Appl. No.: 111,121

[22] Filed: Aug. 24, 1993

[30] Foreign Application Priority Data

Aug. 25, 1992 [DE] Germany ..... 42 28 227.6

[51] Int. Cl.[6] ..... A24F 47/00

[52] U.S. Cl. ..... 131/70

[58] Field of Search ..... 131/329, 70, 72

[56] References Cited

U.S. PATENT DOCUMENTS

| | | | |
|---|---|---|---|
| 33,889 | 12/1861 | Kneeland . | |
| 236,510 | 1/1881 | Paceholder . | |
| 439,004 | 10/1890 | Harris . | |
| 1,144,824 | 6/1915 | Dula . | |
| 1,165,000 | 12/1915 | Dula . | |
| 1,989,130 | 1/1935 | Brown . | |
| 2,551,095 | 5/1951 | Chaze | 131/70 |
| 3,364,935 | 1/1968 | Moshy et al. . | |
| 3,633,589 | 1/1972 | Kahane . | |
| 3,822,710 | 7/1974 | Bramhill . | |
| 3,902,504 | 9/1975 | Owens, Jr. et al. . | |
| 3,927,681 | 12/1975 | Bramhill . | |
| 4,505,282 | 3/1985 | Cogbill et al. . | |
| 4,510,950 | 4/1985 | Keritsis et al. . | |
| 4,612,943 | 9/1986 | Meinkowsky | 131/329 |
| 4,632,131 | 12/1986 | Burnett et al. . | |
| 4,887,617 | 12/1989 | Ruppert et al. . | |
| 5,009,237 | 4/1991 | Schmidt et al. . | |
| 5,018,536 | 5/1991 | Liebich . | |
| 5,072,740 | 12/1991 | Gatschmann et al. | 131/70 X |
| 5,133,366 | 7/1992 | Liebich . | |
| 5,141,000 | 8/1992 | Ruppert et al. . | |
| 5,167,241 | 12/1992 | Ruppert et al. . | |

FOREIGN PATENT DOCUMENTS

| | | |
|---|---|---|
| 52533 | 4/1896 | Canada . |
| 167536 | 2/1916 | Canada . |
| 771426 | 11/1967 | Canada . |
| 252263 | 8/1975 | Canada . |
| 980653 | 12/1975 | Canada . |
| 1018420 | 10/1977 | Canada . |
| 143462 | 3/1901 | Germany . |
| 102324 | 11/1916 | Germany . |
| 889578 | of 1951 | Germany . |
| 822964 | 11/1951 | Germany . |
| 2429783 | of 1975 | Germany . |

(List continued on next page.)

*Primary Examiner*—Jennifer Bahr
*Attorney, Agent, or Firm*—Andrus, Sceales, Starke & Sawall

[57] ABSTRACT

Smoking tobacco is provided for self-making finished cigarettes. A tobacco unit (47) includes a plurality of sub-quantity portions (48 or 50, respectively) which are held together by inner and/or outer fixing means (49) to form a stack of separable portions. Each quantity portion (48 or 50) contains substantially the tobacco quantity required for a finished cigarette. The outer surface of the tobacco unit (47) and/or the sub-quantity portions (48 or 50) are all permeable to air such that the tobacco unit or each portion is not drawable as such and hence cannot be smoked. The tobacco portions of unit (47) are each configured like a rod and interconnected by paste to form a rod belt (51), or are configured as a flat oval tobacco unit comprising the plurality of sub-quantity portions (48) as a continuous mass. The coherence of the tobacco unit (47) is such that when a sub-quantity (48 or 50) is separated from the adjacent portion, the sub-quantity portion removed and the immediately adjacent portion are necessarily destroyed or broken up whereby the internal coherence thereof is lost. A stuffing device is shown having a magazine (52) with which the tobacco unit is place. The magazine is attached to a compression chamber having an opening through which the tobacco unit is moved into the chamber. A severing knife (1) severs an individual sub-quantity (48 or 50) from the unit, and compression bar in the magazine compresses the tobacco into a tobacco bar corresponding to the tobacco in a finished cigarette.

13 Claims, 3 Drawing Sheets

FOREIGN PATENT DOCUMENTS

| | | | |
|---|---|---|---|
| 2406038 | 8/1975 | Germany | 131/329 |
| 2428313 | 1/1976 | Germany | 131/329 |
| 7615067 | 5/1976 | Germany . | |
| 3149584 | of 1981 | Germany . | |
| 8326921 | of 1983 | Germany . | |
| 8309186 | of 1983 | Germany . | |
| 3244906 | of 1984 | Germany . | |
| 6703935 | 9/1968 | Netherlands . | |
| 2208351 | 3/1989 | United Kingdom | 131/329 |

SMOKING TOBACCO FOR SELF-MAKING A CIGARETTE, AND DEVICE THEREFOR

BACKGROUND OF THE PRESENT INVENTION

This invention is concerned with a preformed smoking tobacco for self-making a cigarette by using a prefabricated cigarette paper tube and smoking tobacco.

DE-C-3,244,906 discloses a smoking tobacco which consists of a tobacco quantity of approximately equal sub-quantities constituting a unit of sale, in which the smoking tobacco is held together either wholly or at least in part by a wrapper of completely smokable material. Every sub-quantity is approximately rod-shaped so as to permit self-making of a self-rolled cigarette. Every sub-quantity also corresponds to the tobacco quantity required for a cigarette. The wrapper of the known smoking tobacco consists of perforated or mesh-like material through which air cannot be drawn. The known smoking tobacco is subdivided into rod-like sub-quantities by pressing, scoring, punching, perforating, cutting, inserted threads or the like. In accordance with a preferred embodiment the sub-quantities are aligned in a row by forming a rod belt so that they are easily detachable from each other without, however, damaging the individual sub-quantities or causing loss of the internal coherence of the individual sub-quantities. At least sections of the known smoking tobacco may contain a fixing agent for increasing the internal coherence of each sub-quantity.

The known smoking tobacco is intended to permit the self-making of a cigarette without any special aids such as an auxiliary wrapper of non-smokable material and without transfer means. In many countries there exists the problem that a smoking tobacco of the known kind, in which rod-like sub-quantities may be removed without damage thereto for self-making of cigarettes by enclosing it with cigarette paper, is subjected to duties just like cigarettes. The same applies, by the way, for the tobacco portions disclosed in DE-C-3,407,461 or EP-B-155,514.

SUMMARY OF THE INVENTION

It is the objective of the present invention to provide a smoking tobacco which offers all of the advantages of pre-portioned tobacco sub-quantities for the self-making of cigarettes as well as the favourable duty treatment also in countries where rod-like tobacco portions, which cannot be smoked per se but become smokable after being wrapped with cigarette paper, are subjected to duties just like cigarettes.

Moreover, it is an objective of the present invention to provide a device for processing the smoking tobacco configured in accordance with the invention, preferentially by making maximum use of known mechanisms for cigarette stuffing devices.

The gist of the smoking tobacco configured in accordance with the present invention resides in configuring the tobacco portion comprising two or more sub-quantities in such a way that upon separation of one sub-quantity the immediately adjacent sub-quantity will of necessity be damaged or broken by removal of the internal coherence of the same. This means that upon separation of one sub-quantity neither said sub-quantity nor the immediately contiguous sub-quantity can be transferred into a prefabricated cigarette paper tube unless special provisions are made. Upon separation of a sub-quantity the coherence thereof is destroyed so that it will practically disintegrate "under one's hand". The same applies to the sub-quantity which is immediately adjacent the separated one. Hence, upon separation of a sub-quantity there remains nothing but a tobacco quantity which is pre-portioned along the length of the tobacco receiving space of a cigarette paper tube.

Moreover, the embodiment in which in one tobacco portion is constituted by a flat oval tobacco unit comprising two or more sub-quantities and in which the coherence is ensured by a highly porous wrapper of smokable material, exhibits the advantage that as compared with the prior art considerably less "paper", i.e. wrapper material per sub-quantity of tobacco has to be smoked. This considerably enhances the acceptance of this embodiment by the consumer.

The first alternative in which the tobacco portion is constituted by two or more rod-like sub-quantities which are joined—especially by pasting—to form a rod belt exhibits the advantage that the tobacco rods may be manufactured like a cigarette on a modified cigarette bar machine. The tobacco rods are separated just like cigarettes from a continuously manufactured tobacco bar. Subsequently, they are pasted together in side-by-side relationship whereby a rod belt is formed, pasting being preferentially effected so that, when a sub-quantity is separated from the rod belt, both said sub-quantity and the immediately adjacent one will break up. To this end the glue penetrates into the outer envelope of the individual tobacco rods along the pasting seam. If the tobacco rods are held together by internal binding agents, the glue will properly penetrate into each tobacco rod so as to ensure the aforementioned disintegration of the tobacco rods upon separation from one another.

Preferentially, the tobacco contained in the tobacco portion or in each sub-quantity is compressed so as to make sure that the respective separate sub-quantities cannot be controlled manually. This means that upon release of the internal coherence of each sub-quantity the same will expand radially and lose its dimensional stability.

The device which is adapted in accordance with the present invention for stuffing prefabricated cigarette paper tubes by making use of the aforementioned smoking tobacco is characterised on the one hand by making maximum possible use of conventional stuffing devices and on the other hand by an additional measure according to which the tobacco filling opening cooperates with a magazine for accommodating the above-described inventive tobacco portion and for introducing sub-quantities thereof into the compression chamber of the stuffing device. Preferentially, the aforementioned magazine is defined by a receiving cavity which is situated above the tobacco filling opening and the free cross-section of which corresponds to the cross-section of the tobacco filling opening. The receiving cavity may cooperate with a ram for pushing further tobacco sub-quantities into the open compression chamber. Alternatively, at least one and preferentially both longitudinal sides of the receiving cavity are provided with a recess extending close to the area above the tobacco filling opening for further pressing or pushing sub-quantities of the tobacco portion—for instance with the user's finger.

Also, the device according to the invention is preferentially provided with a cutting blade or similar severing member, e.g. a squeezer bar or the like. The aforementioned severing member cooperates with the tobacco filling opening of the stuffing device and is positioned above the pressing bar, the severing movement preferentially being in advance of the movement of the pressing bar in pressing direction.

As regards further structural details reference shall be made to claim 12 and the following claims.

BRIEF DESCRIPTION OF THE DRAWINGS

Below, two embodiments of a smoking tobacco configured in accordance with the present invention and a device adapted for processing said smoking tobacco for self-making of cigarettes will be explained with reference to the accompanying drawing.

In the drawing.

DESCRIPTION OF THE ILLUSTRATED EMBODIMENT

Figure 1:
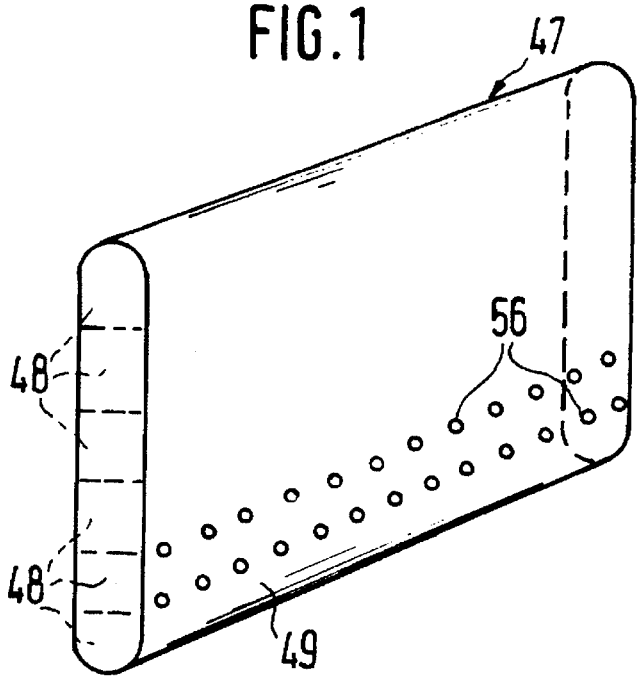
FIG. 1 is a perspective view of a first embodiment of the smoking tobacco according to the present invention.

As will be apparent from FIG. 1, the tobacco intended for the self-making of cigarettes by using prefabricated cigarette paper tubes, especially filter-tipped cigarette paper tubes, is composed of a tobacco portion 47 comprising at least two and in the present case six sub-quantities held together by an outer wrapper of highly porous and smokable material, wherein each sub-quantity contains approximately the tobacco quantity required for one cigarette. The six sub-quantities of the tobacco portion 47 shown in FIG. 1 are indicated at 48. The aforementioned wrapper which confines the six sub-quantities is indicated at 49. It is made of highly porous cigarette paper or mat material which consists of smokable material and is porous or air-permeable to such an extent that one may not draw on the tobacco portion 47 as such so that it is not smokable. To this end the tobacco portion 47 must be subdivided in discrete sub-quantities 48 and each of said discrete sub-quantities must be wrapped in cigarette paper, especially introduced into a prefabricated cigarette paper tube. The tobacco portion 47 shown in FIG. 1 is a flat oval or flat bar-like tobacco unit; i.e., the individual sub-quantities 48 are integrally joined to each other within said unit or within the outer wrapper 49, i.e., they are not separate from each other.

Figure 2:
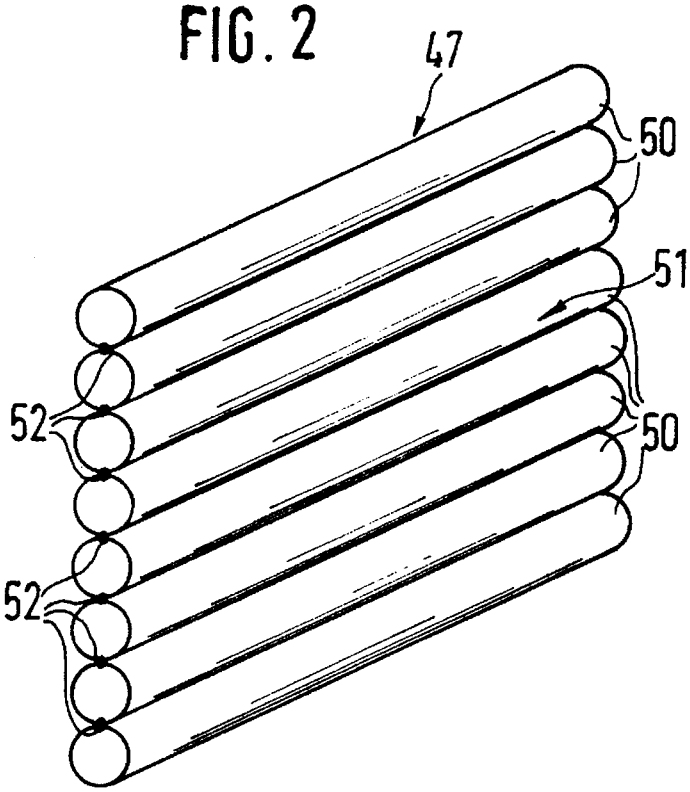
FIG. 2 is a perspective view of a second embodiment of the smoking tobacco according to the present invention.

The embodiment shown in FIG. 2 differs somewhat from the above configuration. Here, the tobacco portion 47 is subdivided into discrete, viz. eight rod-like sub-quantities 50. These sub-quantities 50 are joined, especially pasted together, to form a rod belt 51 (longitudinal pasting seams 52), and thereby tobacco portion. The discrete tobacco rods 50 may be manufactured on a modified cigarette bar machine similar to the tobacco portions disclosed in EP-B-155,514. After manufacture the tobacco rods 50 are arranged in groups in side-by-side relationship and are glued to each other along a longitudinal generating line in such a way that upon separation of a sub-quantity 50 said sub-quantity and the immediately adjacent one are of necessity destroyed or broken up by releasing the internal coherence so that after separation they cannot readily be introduced into a prefabricated cigarette paper tube. To this end a device such as in particular a stuffing device is required. It would also be conceivable to wrap such a broken-up sub-quantity with cigarette paper, as done by those who roll their own cigarettes, and to do so either manually or by means of a known wrapping device. This kind of self-making of a cigarette requires some considerable skill. However, the advantage of the described tobacco portion in conjunction with the conventional self-rolling of cigarettes resides in that the tobacco is precisely pre-portioned and is approximately uniformly distributed along the length of the cigarette. In this respect the described tobacco portion comprising the sub-quantities 50 offers considerable advantages in respect of the self-rolling of cigarettes as compared with the prior art. Above all, it should be considered that the discrete sub-quantities, once they have lost their internal coherence, are in a relatively lose state so that the cigarette paper may be wrapped about the tobacco which is held under radial compression, as is done conventionally, so that a proper drawable cigarette will result.

In order to additionally promote the aforementioned effect the tobacco in the tobacco portion 47 or in the sub-quantities 50 is preferentially compressed radially. To ensure breaking of the sub-quantities 50 as described above a glue is used for joining the discrete sub-quantities 50, said glue penetrating the wrapper material so that upon breaking-off of a sub-quantity both the wrapper of said sub-quantity and the wrapper of the next-adjacent sub-quantity will of necessity break apart. In case the discrete sub-quantities 50 are held together by an internal fixing agent or binding agent, the glue preferentially penetrates into the tobacco filling so as to cancel the internal coherence when a sub-quantity has been broken off.

The length of the tobacco portion 47 as a rule corresponds to the length of the tobacco receiving space of the cigarette paper tube in which a sub-quantity is to be placed.

The above-described tobacco portions require a correspondingly adapted device for stuffing cigarettes by using prefabricated cigarette paper tubes. With reference to FIGS. 3 to 6 an embodiment of a correspondingly adapted cigarette stuffing device will be described in detail. The device comprises a casing consisting of a lower casing part 11 and an upper casing part 12. The upper casing part is formed with an elongate opening, viz. a tobacco filling opening 13 which opens into a tobacco compression chamber 14. The compression chamber 14 is defined on the one hand by a semicircular wall portion 40 and on the other hand by an opposed semicircular face 16 of a horizontally displaceable pressing bar 17. The inner wall portion 40 is part of an outer sidewall 41 associated with the compression chamber 14, said outer sidewall being configured as a double-wall the outer wall portion 42 of which is made to be displaceable in tobacco ejecting direction relative to the inner wall portion 40. To this end the outer wall portion 42 is provided with an extension 43 projecting through an elongate slot 44 in the inner wall portion 40 and being slidably supported therein. The extension 43 carries a ram-like ejecting slide 25. The wall portion 42 and the ejecting slide 25 constitute an integral component, i.e. a component which is jointly slidable to and fro in longitudinal direction of the tobacco compression chamber 14. Further, the outer wall portion 42 is joined by way of a relieved guide means 46 with the lower casing part 11 whereby a rectilinear guide means is formed. A grip 29 is disposed on the top of the outer wall portion 42. The end 20 of the pressing bar 17 which is diametrically opposed to the wall portion 16 is coupled with a lever 21 which may concurrently be designed as a handling member 23. The latter may, for instance, be a moulded plastic part. The handling member 23 is supported for rotation about a horizontal axis which is defined by pivots 22 integrally formed on the sides of the handling member 23. These pivots 22 are journaled for rotation in dish-like bearing shells 45 and are retained within the bearing shells 45 by a protrusion 39 provided on the inside of the upper casing part 12.

The diametrically opposed end 20 of the pressing bar 17 has two L-shaped arms 24 integrally formed thereon with a mutual axial spacing, and L-shaped control grooves 2 are formed on the inner sides of said arms facing each other into which guide pins 6 protrude which are integrally formed on the sides of the handling member 23, wherein the two guide pins 6 are respectively formed on the two outer sides of the lateral bounding walls of the handling member 23. Further guide pins are integrally formed on the inner sides of the lateral bounding walls of the handling member 23 in alignment with the guide pins 6. These guide pins correspond respectively with arcuate control grooves 3 formed on the outer side of two arms 18 which are likewise arranged with a mutual axial spacing but are disposed intermediate the already mentioned two L-shaped arms 24, said arms 18 forming part of a cutting blade 1 which is slidable to and fro between upper casing part 12 and pressing bar 17. The control grooves 2 and 3 are designed and arranged relative to each other such that, when the handling member 23 is actuated in pressing direction (arrow 19), the cutting blade 1 will be in advance of the pressing ram 17. It is preferred that the cutting blade 1, which is reciprocable in parallel to the pressing ram 17, is coupled to the handling member 23 such that the movement of the pressing ram 17 in pressing direction will only commence after the cutting blade 1 has moved across the tobacco filling opening 13, i.e. when it is in its final cutting position. To achieve this the embodiment of FIG. 6 is provided with the L-shaped control groove 2 the shorter leg of which extends in spaced relation from the pressing bar 17 approximately in parallel with the direction of movement thereof in a direction away from the compression chamber 14. Furthermore, the clear width of the upper horizontal arm of the control groove 2 is larger than the outer diameter of the associated pin 6 so that, when the handling member 23 is pivoted in pressing direction 19 from the filling position, the guide pin 6 in the upper horizontal arm of the guide groove 2 will initially remain ineffective, resulting in the pressing bar 17 staying in its retracted position shown in FIG. 6. However, the pins integrally formed on the inner side of the handling member 23 and disposed in alignment with the pins 6 correspond from the very beginning with the control grooves 3 cooperating with the cutting blade 1 so that the cutting blade 1 is moved without any delay in a tobacco cutting direction, and consequently the cutting blade 1 is fully effective prior to the pressing bar 17 becoming effective. The described process of motion can be reconstructed with reference to FIGS. 3 to 5. When the tobacco compression chamber is opened the process of motion is reversed, i.e., the cutting blade 1 lags behind the pressing bar 17.

For the pressing bar 17 to stay in the pressing position an enlargement 15 is provided at the bottom of each control groove 2 in which the guide pins 6 may lock. As will be apparent from FIG. 6, the enlargement 15 and hence the mentioned snap-in connection are beneath the imaginary connecting line between the tobacco compression chamber 14 and the pivot of the handling member 23, so that the locked position of the handling member 23 is an "over dead-centre position".

For handling the tobacco portions 47 of FIG. 1 or FIG. 2, respectively, the tobacco filling opening 13 cooperates with a magazine 52 for accommodating and introducing sub-quantities of the aforementioned tobacco portion 47. In the illustrated embodiment the magazine is defined by a receiving cavity 53 disposed above the tobacco filling opening 13, the free cross-section of the cavity corresponding to the cross-section of the tobacco filling opening 13. The receiving cavity 53 may cooperate with a ram for pushing tobacco sub-quantities into the open compression chamber 14 of the stuffing device. FIGS. 3 to 6 do not show such a ram; it is merely indicated by the arrow 54 in FIGS. 3 and 6.

Figure 9:
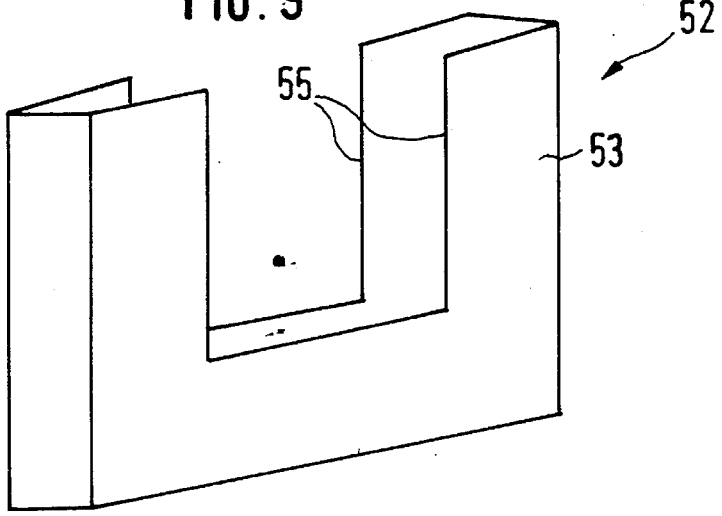
FIG. 9 is a schematic view showing an embodiment of a tobacco magazine cooperating with the filling opening of the tobacco compression chamber of a stuffing device.

In order to obviate the use of a ram 54 for pushing against the tobacco portion 47 the receiving cavity 53 of FIG. 9 is provided with a recess 55 on either of its longitudinal sides. The recess 55 extends from the top edge of the receiving cavity 53 close to the top of the tobacco filling opening 13. The recess 55 is used for pressing or pushing sub-quantities of the tobacco portion 47 for instance with the user's index finger. In this way the aforementioned ram 54 for pushing in sub-quantities of the tobacco portion 47 according to FIG. 1 or 2 can be omitted.

Figure 3:
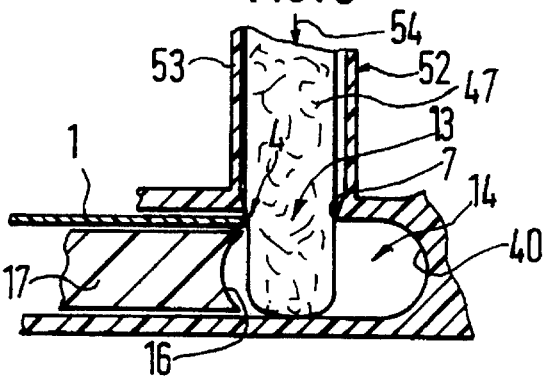
FIGS. 3 to 5 are respective fragmentary cross-sectional views illustrating the severing movement of a cutting blade provided in accordance with the invention as related to the filling opening of the tobacco compression chamber of a stuffing device as related to the movement of the cooperating pressing bar.
Figure 4:
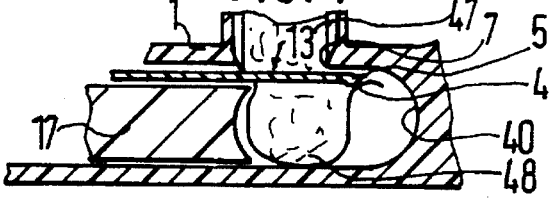
Figure 5:
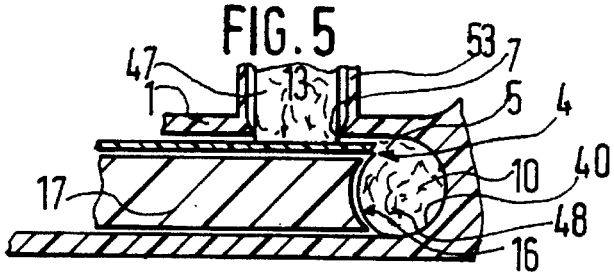
Figure 6:
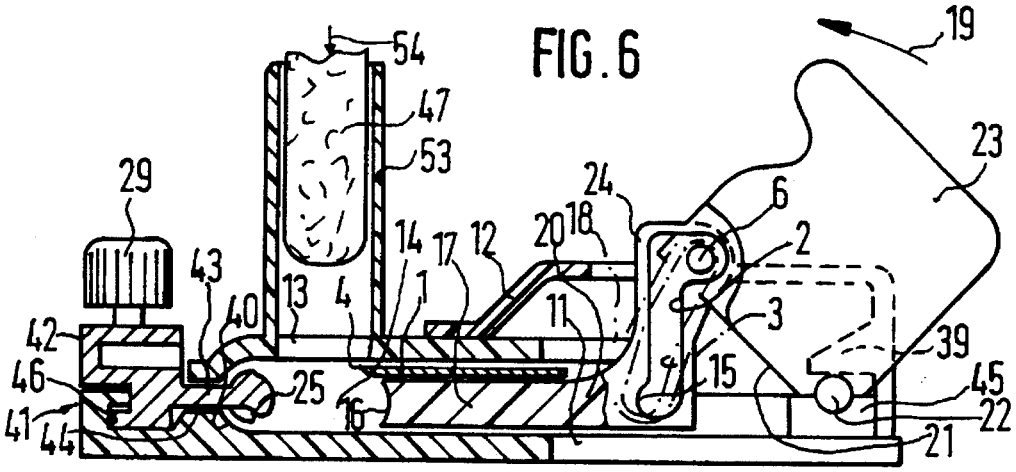
FIG. 6 is a cross-sectional view of an embodiment of a stuffing device provided with a cutting blade and a magazine each according to the present invention.
Figure 7:
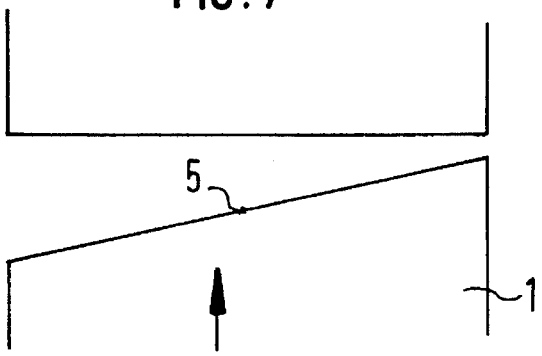
FIG. 7 is a schematic plan view showing a first embodiment of a tobacco cutting blade provided in a stuffing device in accordance with the present invention.
Figure 8:
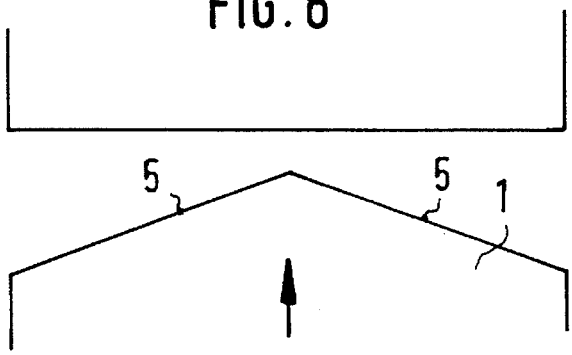
FIG. 8 is a schematic plan view showing a second embodiment of a tobacco cutting blade provided in a stuffing device according to the invention.

Hence, as shown in FIGS. 3 to 5, tobacco for example in the form of the tobacco portion 47 of FIG. 1 is initially introduced through the receiving cavity 53 and the filling opening 13 into the tobacco compression chamber 14, the tobacco portion 47 being pushed as shown in FIG. 3 into the receiving cavity 43 until its bottom edge abuts the bottom of the tobacco compression chamber 14. Subsequently, the leading cutting blade 1 cuts a sub-quantity 47 off the tobacco portion 47 while the filling opening 13 is closed simultaneously. To this end the front edge 4 of the cutting blade 1 facing the compression chamber 14 has a knife edge 5. As shown in FIG. 7 the knife edge may extend guillotine-fashion at an inclination along the length of the compression chamber 14. Alternatively, the knife edge 5 may also be configured like a conical roof as shown in FIG. 8. Finally, it is also conceivable that the knife edge 5 is provided with serrations.

Instead of the cutting blade 1 it is also possible to provide a squeezer bar or similar separating element having the same effect, and as used herein "knife" shall include all such functioning elements which function to removing the sub-quantity in moving through the tobacco portion 47.

The cutting blade 1 actually rolls the sub-quantity 48 separated from the tobacco portion 47 into the tobacco compression chamber 14 while cancelling the internal coherence of said sub-quantity. Any protruding tobacco shreds and any remainders of the porous wrapper 49 are severed between the knife edge 5 and the delimiting edge 7 of the filling opening 13 opposite the pressing bar 17 so that the severed sub-quantity 48 including the severed wrapper 49 is completely disposed inside the tobacco compression chamber 14. Thereafter the finally formed tobacco roll 10 shown in FIG. 5 can easily be ejected from the tobacco compression chamber 14. In the tobacco compressing position, as will also be apparent from FIG. 5, the pressing bar 17 and the front edge 4 or the knife edge 5 of the cutting blade 1 are approximately flush with the curved pressing face 16 of the pressing bar 17 thus forming an extension of the pressing face 16 of the pressing bar 17.

The tobacco portion of FIG. 2 can be processed in the same way as the tobacco portion 47 of FIG. 1 with the described stuffing device.

In a comfort device a saw driven by an electric motor may be provided instead of the described cutting blade 1, in particular a circular saw blade adapted to be moved into the tobacco filling opening in accordance with FIGS. 3 to 6.

In a less comfortable stuffing device it would also be conceivable for the cutting blade to be moved to the tobacco severing position by means of a separate handling member. In that case the cutting blade may be configured like a kitchen knife which is adapted to be moved through a bottom slot in the lower portion of the receiving cavity 53 in longitudinal direction of the tobacco compression chamber to thereby sever the desired sub-quantity 48 or 50, respectively.

In order to facilitate the separation of sub-quantities 48 in the embodiment of a tobacco portion as shown in FIG. 1 the wrapper 49 may be provided with longitudinally extending perforations 56 which define the longitudinal dividing lines between neighbouring sub-quantities 48. Instead of the linear perforations 56 it is also possible to provide different predetermined breaking lines in the wrapper 49. However, the predetermined breaking lines must be given sufficient strength to ensure the coherence of the tobacco portion 47 outside of the magazine 52 of the described stuffing device.

All of the features disclosed in the present application papers are claimed as being essential to the invention to the extent to which they are novel over the prior art either individually or in combination.

We claim:

1. A smoking tobacco device for self-making a cigarette from tobacco and a prefabricated cigarette paper tube having a finished tobacco space of a given length and round constant cross-section throughout its length, comprising a tobacco unit (47) formed of tobacco particles and including a plurality of individual preformed sub-quantity portions (48 or 50, respectively), each said sub-quantity having a constant cross-section substantially corresponding to the cross-section of tobacco space and at least as long as said given length, a fixing means (49) securing said sub-quantity portions in abutting and stacked relationship along the length or said portions to form said tobacco unit as a stack of said sub-quantity portions with elongated separation line at each abutting surface, each of said sub-quantities containing substantially the tobacco quantity of tobacco particles required for filling said tobacco space and form a cigarette, each said sub-quantity portion (48 or 50) having an outer air permeable surface such that it is not drawable as such and hence cannot be smoked, said sub-quantity portion in said stack having an internal coherence of the tobacco particles such that when a sub-quantity portion (48 or 50) is separated from the attached abutting sub-quantity portion in said stack said removed sub-quantity portion and said abutting sub-quantity are broken up and the internal coherence is lost and thereby providing a removed sub-quantity portion in the form of a substantially loose tobacco particle supply.

2. The smoking tobacco of claim 1, wherein each sub-quantity (48 or 50) has a length corresponding to the length of the tobacco receiving space of a prefabricated cigarette paper tube.

3. The smoking tobacco of claim 1, in which each sub-quantity (48 or 50) is in the form of a cylinder tobacco rod of tobacco particles corresponding to a cylindrical tobacco charge as formed in factory manufacture of finished cigarettes, said tobacco rods being interconnected to form said tobacco unit as a rod belt (41).

4. The smoking tobacco of claim 1, including an outer wrapper (49) secured about the tobacco unit and forming said fixing means for the tobacco portion (47).

5. The smoking tobacco of claim 1, wherein each of said sub-quantity portions includes a smokeable tobacco binder for binding of the tobacco particles, and said fixing means including an element to effectively destroy said binding in response to separating of a sub-quantity portion from said stack.

6. The smoking tobacco of claim 1, wherein the tobacco particles within each sub-quantity portion (48 or 50) are compressed, said fixing means maintains each of said sub-quantity portions in said stack in said compressed state and releases said compressed state upon removal therefrom.

7. A device for stuffing prefabricated cigarette paper tubes, with tobacco to form a finished cigarette from a tobacco unit, comprising a tobacco compression chamber (14) having a longitudinal extent and having a filling opening (13) for filling the chamber with tobacco to be compressed to form a tobacco bar (10), a pressing bar unit (17) adapted to be moved transversely of the longitudinal direction of the tobacco compression chamber (14) to compress tobacco in said chamber to form said tobacco bar, and comprising a fitting for fixing the cigarette paper tube thereon in communication with said chamber, clamping means for retaining the cigarette paper tube on said fitting, and an ejection slide (25) in said chamber for ejecting the tobacco bar (10) from the compression chamber (14) into the cigarette paper tube, characterized in a tobacco magazine (42) connected to said filling opening and having a receiving cavity (53) with a tobacco unit (47) therein, said tobacco unit including a plurality of individual preformed sub-quantity portions of tobacco particles, a fixing means connected to said tobacco unit for securing said sub-quantity portions in a stacked abutting relation, each of said sub-quantity portions having an internal coherence of the tobacco particles such that when a sub-quantity portion (48 or 50) is separated from the attached abutting sub-quantity portion in said stack said removed sub-quantity portion and said abutting sub-quantity are broken up and the internal coherence is lost and thereby providing a removed sub-quantity portion in the form of a substantially loose tobacco particle supply, said magazine having a discharge opening aligned with the tobacco unit and the filling opening, the free cross-section of the receiving cavity corresponding to the cross-section of the tobacco filling opening (13) wherein said tobacco unit moves into said chamber, a structure for introducing a single sub-quantity portion from said tobacco unit into the compression chamber (14), a separation unit located between said magazine and said compression chamber and operable to remove said single sub-quantity portion from said tobacco unit and simultaneously said fixing means and thereby receiving said sub-quantity in the form of a substantially loose tobacco particle supply into said tobacco compression chamber (14), said magazine includes at least one longitudinal exterior side thereof with a recess (55) extending close to a position above the tobacco filling opening (13) for manual advancing sub-quantities of the tobacco unit (47) including advancing using a finger of the user.

8. A device for stuffing prefabricated cigarette paper tubes cigarette paper tubes with tobacco to form a finished cigarette from a tobacco unit, comprising a tobacco compression chamber (14) having a longitudinal extent and having a filling opening (13) for filling the chamber with tobacco to be compressed to form a tobacco bar (10), a pressing bar unit (17) adapted to be moved transversely of the longitudinal direction of the tobacco compression chamber (14) to compress tobacco in said chamber to form said tobacco bar, and comprising a fitting for fixing the cigarette paper tube thereon in communication with said chamber, clamping means for retaining the cigarette paper tube on said fitting, sand an ejection slide (25) in said chamber for ejecting the tobacco bar (10) from the compression chamber (14) into the cigarette paper tube, characterized in a tobacco magazine (42) connected to said filling opening and having a receiving cavity (53) with a tobacco unit (47) therein, said tobacco unit including a plurality of individual preformed sub-quantity portions of tobacco particles, a fixing means connected to said tobacco unit for securing said sub-quantity portions in a stacked abutting relation, each of said sub-quantity portions having an internal coherence of the tobacco particles such that when a sub-quantity portion (48 or 50) is separated from the attached abutting sub-quantity portion in said stack said removed sub-quantity portion and said abutting sub-quantity are broken up and the internal coherence is lost and thereby providing a removed sub-quantity portion in the form of a substantially loose tobacco particle supply, said magazine having a discharge opening aligned with the tobacco unit and the filling opening, the free cross-section of the receiving cavity corresponding to the cross-section of the tobacco filling opening (13) wherein said tobacco unit moves into said chamber, a structure for introducing a single sub-quantity portion from said tobacco unit into the compression chamber (14), a separation unit located between said magazine and said compression chamber and operable to remove said single sub-quantity portion from said tobacco unit and simultaneously said fixing means and thereby receiving said sub-quantity in the form of a substantially loose tobacco particle supply into said tobacco compression chamber (14), said separation unit including a severing member (1) having a knife edge and operative at least along part of the length of the compression chamber between said tobacco filling opening (13) and the pressing bar unit (17), said severing member being reciprocally mounted in parallel with said pressing bar (17), an operator is connected to said severing member and to said pressing bar, said operator includes an operating handle (23), and said handle being connected to the pressing bar unit (17) such that the movement of the pressing bar (17) in a pressing direction commences only when the severing member (10) has reached the final severing position.

9. The device of claim 8, wherein said operating handle (23) includes first and second cam elements, said pressing bar (17) and said severing member (1) having cam members coupled one each to said first and second cam elements such that upon movement of the handle (23) in the tobacco pressing direction (arrow 19) the severing member (1) reaches a final severing position before the pressing bar (17) moves in pressing direction.

10. A device for stuffing prefabricated cigarette tubes with tobacco to form a finished cigarette from a tobacco unit, comprising a tobacco compression chamber (14) having a longitudinal extent and having a filling opening (13) for filling the chamber with tobacco to be compressed to form a tobacco bar (10), a pressing bar unit (17) adapted to be moved transversely of the longitudinal direction of the tobacco compression chamber (14) to compress tobacco in said chamber to form said tobacco bar, and comprising a fitting for fixing the cigarette paper tube thereon in communication with said chamber, clamping means for retaining the cigarette paper tube on said fitting, and an ejection slide (25) in said chamber for ejecting the tobacco bar (10) from the compression chamber (14) into the cigarette paper tube, characterized in a tobacco magazine (42) connected to said filling opening and having a receiving cavity (53) with a tobacco unit (47) therein, said tobacco unit including a plurality of individual preformed sub-quantity portions of tobacco particles, a fixing means connected to said tobacco unit for securing said sub-quantity portions in a stacked abutting relation, each of said sub-quantity portions having an internal coherence of the tobacco particles such that when a sub-quantity portion (48 or 50) is separated from the attached abutting sub-quantity portion in said stack said removed sub-quantity portion and said abutting sub-quantity are broken up and the internal coherence is lost and thereby providing a removed sub-quantity portion in the form of a substantially loose tobacco particle supply, said magazine having a discharge opening aligned with the tobacco unit and the filling opening, the free cross-section of the receiving cavity corresponding to the cross-section of the tobacco filling opening (13) wherein said tobacco unit moves into said chamber, a structure for introducing a single sub-quantity portion from said tobacco unit into the compression chamber (14), a separation unit located between said magazine and said compression chamber and operable to remove said single sub-quantity portion from said tobacco unit and simultaneously said fixing means and thereby receiving said sub-quantity in the form of a substantially loose tobacco particle supply into said tobacco compression chamber (14), said separation unit including a severing member operative at least along part of the length of the compression chamber between said tobacco filling opening (13) and the pressing bar unit (17), said pressing bar unit (17) and severing member (1) each include a cam element (2 and 3, respectively), an operator (23) having cam members (6) coupled to said cam elements such that upon movement of the operator (23) in a tobacco pressing direction (arrow 19) the severing member (1) moves in advance of the pressing bar moving in the direction of the final pressing position.

11. A device for stuffing prefabricated cigarette paper tubes with tobacco to form a finished cigarette from a tobacco unit, comprising a tobacco compression chamber (14) having a longitudinal extent and having a filling opening (13) for filling the chamber with tobacco to be compressed to form a tobacco bar (10), a pressing bar unit (17) adapted to be moved transversely of the longitudinal direction of the tobacco compression chamber (14) to compress tobacco in said chamber to form said tobacco bar, and comprising a fitting for fixing the cigarette paper tube thereon in communication with said chamber, clamping means for retaining the cigarette paper tube on said fitting, and an ejection slide (25) in said chamber for ejecting the tobacco bar (10) from the compression chamber (14) into the cigarette paper tube, characterized in a tobacco magazine (42) connected to said filling opening and having a receiving cavity (53) with a tobacco unit (47) therein, said tobacco unit including a plurality of individual preformed sub-quantity portions of tobacco particles, a fixing means connected to said tobacco unit for securing said sub-quantity portions in a stacked abutting relation, each of said sub-quantity portions having an internal coherence of the tobacco particles such that when a sub-quantity portion (48 or 50) is separated from the attached abutting sub-quantity portion in said stack said removed sub-quantity portion and said abutting sub-quantity are broken up and the internal coherence is lost and thereby providing a removed sub-quantity portion in the form of a substantially loose tobacco particle supply, said magazine having a tobacco filling opening and a discharge opening aligned with the tobacco unit and the filling opening, the free cross-section of the receiving cavity corresponding to the cross-section of the tobacco filling opening (13) wherein said tobacco unit moves into said chamber, a structure for introducing a single sub-quantity portion from said tobacco unit into the compression chamber (14), and a separation unit located between said magazine and said compression chamber and operable to remove said single sub-quantity portion from said tobacco unit and simultaneously said fixing means and thereby receiving said sub-quantity in the form of a substantially loose tobacco particle supply into said tobacco compression chamber (14), said separation unit including a severing member operative at least along part of the length of the compression chamber between said tobacco filling opening (13) and the pressing bar unit (17), said severing member (1) having a knife edge (5) which extends at an inclination or guillotine fashion along the length of the compression chamber (14).

12. A device for stuffing prefabricated cigarette paper tubes with tobacco to form a finished cigarette from a tobacco unit, comprising a tobacco compression chamber (14) having a longitudinal extent and having a filling opening (13) for filling the chamber with tobacco to be compressed to form a tobacco bar (10), a pressing bar unit (17) adapted to be moved transversely of the longitudinal direction of the tobacco compression chamber (14) to compress tobacco in said chamber to form said tobacco bar, and comprising a fitting for fixing the cigarette paper tube thereon in communication with said chamber, clamping means for retaining the cigarette paper tube on said fitting, and an ejection slide (25) in said chamber for ejecting the tobacco bar (10) from the compression chamber (14) into the cigarette paper tube, characterized in a tobacco magazine (42) connected to said filling opening and having a receiving cavity (53) with a tobacco unit (47) therein, said tobacco unit including a plurality of individual preformed sub-quantity portions of tobacco particles, a fixing means connected to said tobacco unit for securing said sub-quantity portions in a stacked abutting relation, each of said sub-quantity portions having an internal coherence of the tobacco particles such that when a sub-quantity portion (48 or 50) is separated from the attached abutting sub-quantity portion in said stack said removed sub-quantity portion and sad abutting sub-quantity are broken up and the internal coherence is lost and thereby providing a removed sub-quantity portion in the form of a substantially loose tobacco particle supply, said magazine having a tobacco filling opening and a discharge opening aligned with the tobacco unit and the filling opening, the free cross-section of the receiving cavity corresponding to the cross-section of the tobacco filling opening (13) wherein said tobacco unit moves into said chamber, a structure for introducing a single sub-quantity portion from said tobacco unit into the compression chamber (14), and a separation unit located between said magazine and said compression chamber and operable to remove said single sub-quantity portion from said tobacco unit and simultaneously said fixing means and thereby receiving said sub-quantity in the form of a substantially loose tobacco particle supply into said tobacco compression chamber (14), said separation unit includes a severing member operative at least along part of the length of the compression chamber between said tobacco filling opening (13) and the pressing bar unit (17), said severing member (1) includes a conical roof-like knife edge (5).

13. A device for stuffing prefabricated cigarette paper tubes with tobacco to form a finished cigarette from a tobacco unit, comprising a tobacco compression chamber (14) having a longitudinal extent and having a filling opening (13) for filling the chamber with tobacco to be compressed to form a tobacco bar (10), a pressing bar unit (17) adapted to be moved transversely of the longitudinal direction of the tobacco compression chamber (14) to compress tobacco in said chamber to form said tobacco bar, and comprising a fitting for fixing the cigarette paper tube thereon in communication with said chamber, clamping means for retaining the cigarette paper tube on said fitting, and an ejection slide (25) in said chamber for ejecting the tobacco bar (10) from the compression chamber (14) into the cigarette paper tube, characterized in a tobacco magazine (42) connected to said filling opening and having a receiving cavity (53) with a tobacco unit (47) therein, said tobacco unit including a plurality of individual preformed sub-quantity portions of tobacco particles, a fixing means connected to said tobacco unit for securing said sub-quantity portions in a stacked abutting relation, each of said sub-quantity portions having an internal coherence of the tobacco particles such that when a sub-quantity portion (48 or 50) is separated from the attached abutting sub-quantity portion in said stack said removed sub-quantity portion and said abutting sub-quantity are broken up and the internal coherence is lost and thereby providing a removed sub-quantity portion in the form of a substantially loose tobacco particle supply, said magazine having a tobacco filling opening and a discharge opening aligned with the tobacco unit and the filling opening, the free cross-section of the receiving cavity corresponding to the cross-section of the tobacco filling opening (13) wherein said tobacco unit moves into said chamber, a structure for introducing a single sub-quantity portion from said tobacco unit into the compression chamber (14), and a separation unit located between said magazine and said compression chamber and operable to remove said single sub-quantity portion from said tobacco unit and simultaneously said fixing means and thereby receiving said sub-quantity in the form of a substantially loose tobacco particle supply into said tobacco compression chamber (14), said separation unit includes a severing member operative at least along part of the length of the compression chamber between said tobacco filling opening (13) and the pressing bar unit (17), said severing member (1) includes a serrated knife edge (5).

* * * * *

UNITED STATES PATENT AND TRADEMARK OFFICE
CERTIFICATE OF CORRECTION

PATENT NO. : 5,526,825

DATED : June 18, 1996

INVENTOR(S) : Heinrich W. Ruppert et al

It is certified that error appears in the above-identified patent and that said Letters Patent is hereby corrected as shown below:

Column 7, line 45, CLAIM 1, after "length" delete "or" and substitute therefor ---of---; Column 8, line 64, CLAIM 8, delete "cigarette paper tubes" (second occurrence); Column 9, line 8, CLAIM 8, delete "sand" and substitute therefor ---and---; Column 9, line 56, CLAIM 10, after "cigarette" insert ---paper---; Column 11, line 43, CLAIM 12, delete "sad" and substitute therefor ---and---.

Signed and Sealed this

First Day of July, 1997

Bruce Lehman

*Attest:*

BRUCE LEHMAN

*Attesting Officer*

*Commissioner of Patents and Trademarks*